US010392776B2

(12) United States Patent
Van Gemert

(10) Patent No.: US 10,392,776 B2
(45) Date of Patent: Aug. 27, 2019

(54) JAW ASSEMBLY FOR A DEMOLITION TOOL

(71) Applicant: Caterpillar Work Tools B.V., 's-Hertogenbosch (NL)

(72) Inventor: John Van Gemert, Mill (NL)

(73) Assignee: Caterpillar Work Tools B.V., s-Hertogenbosch (NL)

( * ) Notice: Subject to any disclaimer, the term of this patent is extended or adjusted under 35 U.S.C. 154(b) by 845 days.

(21) Appl. No.: 14/404,738

(22) PCT Filed: Jun. 6, 2013

(86) PCT No.: PCT/EP2013/061647
§ 371 (c)(1),
(2) Date: Dec. 1, 2014

(87) PCT Pub. No.: WO2013/182626
PCT Pub. Date: Dec. 12, 2013

(65) Prior Publication Data

US 2015/0144724 A1 May 28, 2015

(30) Foreign Application Priority Data

Jun. 7, 2012 (EP) ..... 12171210

(51) Int. Cl.
*B02C 1/10* (2006.01)
*E02F 3/96* (2006.01)

(52) U.S. Cl.
CPC ..... *E02F 3/965* (2013.01); *B02C 1/10* (2013.01)

(58) Field of Classification Search
CPC . E02F 3/965; B02C 1/10; B23D 17/00; E21C 23/00

(Continued)

(56) References Cited

U.S. PATENT DOCUMENTS 5,183,216 A 2/1993 Wack
5,474,242 A 12/1995 Rafn (Continued)

FOREIGN PATENT DOCUMENTS

AT 009148 U1 5/2007
CN 1266767 9/2000
CN 101014429 8/2007
DE 102006019069 A1 10/2007
DE 202012100580 U1 5/2012

(Continued)

OTHER PUBLICATIONS

Sep. 26, 2018 Google Definition—Saddle.*

(Continued)

*Primary Examiner* — Shelley M Self
*Assistant Examiner* — Joseph Finan

(57) ABSTRACT

A jaw assembly for a demolition tool is disclosed. The jaw assembly comprises at least one first coupling portion and at least one second coupling portion disposed on a first jaw. The first coupling portion comprises an intermediate contact member and side contact members laterally extending from opposite sides of the intermediate contact member. A wear plate comprises a body element saddling the intermediate contact member, a pair of spaced apart first engagement elements extending from an end of the body, and a pair of spaced apart second engagement elements extending from an opposite end for engaging the side contact members. An active module is removably coupled to the second coupling portion and comprises a body member and a pair of braces disposed on opposite sides of the body member, wherein a brace extends over the second coupling elements. The wear plate may be replaced when worn out.

20 Claims, 11 Drawing Sheets

(58) Field of Classification Search
USPC ..... 241/264, 101.73; 144/4.1; 30/228
See application file for complete search history.

(56) References Cited

U.S. PATENT DOCUMENTS

| | | | | |
|---|---|---|---|---|
| 5,533,682 | A * | 7/1996 | de Gier | B23D 17/00 241/101.73 |
| 5,546,683 | A * | 8/1996 | Clark | E02F 3/3631 172/272 |
| 6,119,970 | A | 9/2000 | LaBounty et al. | |
| 6,336,785 | B1 * | 1/2002 | Kunzman | A01B 59/062 37/468 |
| 2003/0132327 | A1 | 7/2003 | Muri | |
| 2007/0245568 | A1 | 10/2007 | Schipp et al. | |
| 2011/0031338 | A1 | 2/2011 | Ramun et al. | |
| 2011/0297773 | A1 | 12/2011 | Nye et al. | |

FOREIGN PATENT DOCUMENTS

| | | | |
|---|---|---|---|
| EP | 1113111 | A1 | 7/2001 |
| JP | 9-217502 | A | 8/1997 |
| JP | 2006511323 | | 12/2006 |

OTHER PUBLICATIONS

U.S. Appl. No. 14/404,888, of John Van Gemert entitled Jaw Assembly for a Demolition Tool, filed Dec. 1, 2014.
International Search Report dated Jul. 5, 2013, in PCT/EP2013/061659 (3 pages).
European Search Report dated Nov. 28, 2012, in European Application EP/12171213 (2 pages).
International Search Report dated Jul. 10, 2013, in PCT/EP2013/061647 (3 pages).
European Search Report dated Nov. 30, 2012, in European Application EP/12171210 (2 pages).

* cited by examiner

JAW ASSEMBLY FOR A DEMOLITION TOOL

CLAIM FOR PRIORITY

This application is a U.S. National Phase entry under 35 U.S.C. § 371 from PCT International Application No. PCT/EP2013/061647, filed Jun. 6, 2013, which claims benefit of priority of European Patent Application No. 12171210.3, filed Jun. 7, 2012, all of which are incorporated herein by reference.

TECHNICAL FIELD

This disclosure relates to the field of demolition tools for crushing and/or cutting material and more particularly to the field of replaceable working parts for demolition tools.

BACKGROUND

A demolition tool for crushing and/or cutting material is generally known. Typically, the demolition tool may comprise a jaw assembly having a lower jaw and an upper jaw. The upper and lower jaws may be pivotally connected. The upper and lower jaws may be moveable relative to each other. Blades may be provided on both the upper jaw and the lower jaw. The work material may be crushed or cut by closing the upper jaw and the lower jaw under hydraulic pressure.

The demolition tool may comprise a frame that connects the jaw set to a jib of a machine.

The demolition tool may have a jaw assembly that is suitable for crushing concrete. The jaw assembly may be adapted for crushing or cutting other materials, for example for cutting scrap iron and/or iron sections. The abrasive nature or hardness of some of these materials may cause the relatively rapid wear of the surfaces that engage the materials.

The demolition tool may be provided with replaceable working parts that have wear surfaces. The working part may be connected directly to the jaw assembly by conventional techniques. The working part may be provided on the upper and/or the lower jaw. The working part may be retained by fasteners.

The present disclosure is directed, at least in part, to improving or overcoming one or more aspects of the prior art system.

BRIEF SUMMARY OF THE INVENTION

In a first aspect, the present disclosure describes a jaw assembly for a demolition tool, the jaw assembly having a first jaw and a second jaw and comprising at least one first coupling portion disposed on the first jaw, the at least one first coupling portion comprising: an intermediate contact member; a pair of side contact members laterally extending from opposite sides of the intermediate contact member, each side contact member having a first protrusion spaced from a second protrusion; a wear plate removably coupled to the at least one first coupling portion, the wear plate comprising: a body element saddling the intermediate contact member; a pair of spaced apart first engagement elements extending from an end of the body are engaged to the first protrusions; a pair of spaced apart second engagement elements extending from an opposite end of the body are engaged to the second protrusions; at least one second coupling portion adjacent to the at least one first coupling portion; an active module removably coupled to the at least one second coupling portion, the active module comprising: a body member mounted at the least one second coupling portion; a pair of braces disposed on opposite sides of the body member wherein a brace extends over the second coupling elements.

In a second aspect, the present disclosure describes a wear plate for removable mounting to a jaw assembly of a demolition tool, the wear plate comprising: a body element configured to saddle an at least one first coupling portion disposed on the first jaw of the jaw assembly; a pair of spaced apart first engagement elements extending from an end of the body element for engaging to first protrusions provided on the at least one first coupling portion; and a pair of spaced apart second engagement elements extending from an opposite end of the body element for engaging to the second protrusions provided on the at least one first coupling portion.

In a third aspect, the present disclosure describes a modular system for removable mounting of replaceable parts to a jaw assembly of a demolition tool, the modular system comprising: a wear plate comprising: a body element configured to saddle an at least one first coupling portion disposed on a first jaw of the jaw assembly; a pair of spaced apart first engagement elements extending from an end of the body element for engaging to first protrusions provided on the at least one first coupling portion; and a pair of spaced apart second engagement elements extending longitudinally from an opposite end of the body element for engaging to the second protrusions provided on the at least one first coupling portion, and an active module comprising: a body member configured to be mountable to the at least one second coupling portion disposed on a first jaw adjacent to the at least one first coupling portion; at least one brace disposed on a side of the body member and configured to extend over the second engagement elements such that when the wear plate and the active module are assembled on the first jaw a brace extends over the second engagement elements to retain the wear plate on the first jaw.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

This disclosure generally relates to replaceable wear parts for a jaw set of a demolition tool.

Figure 1:
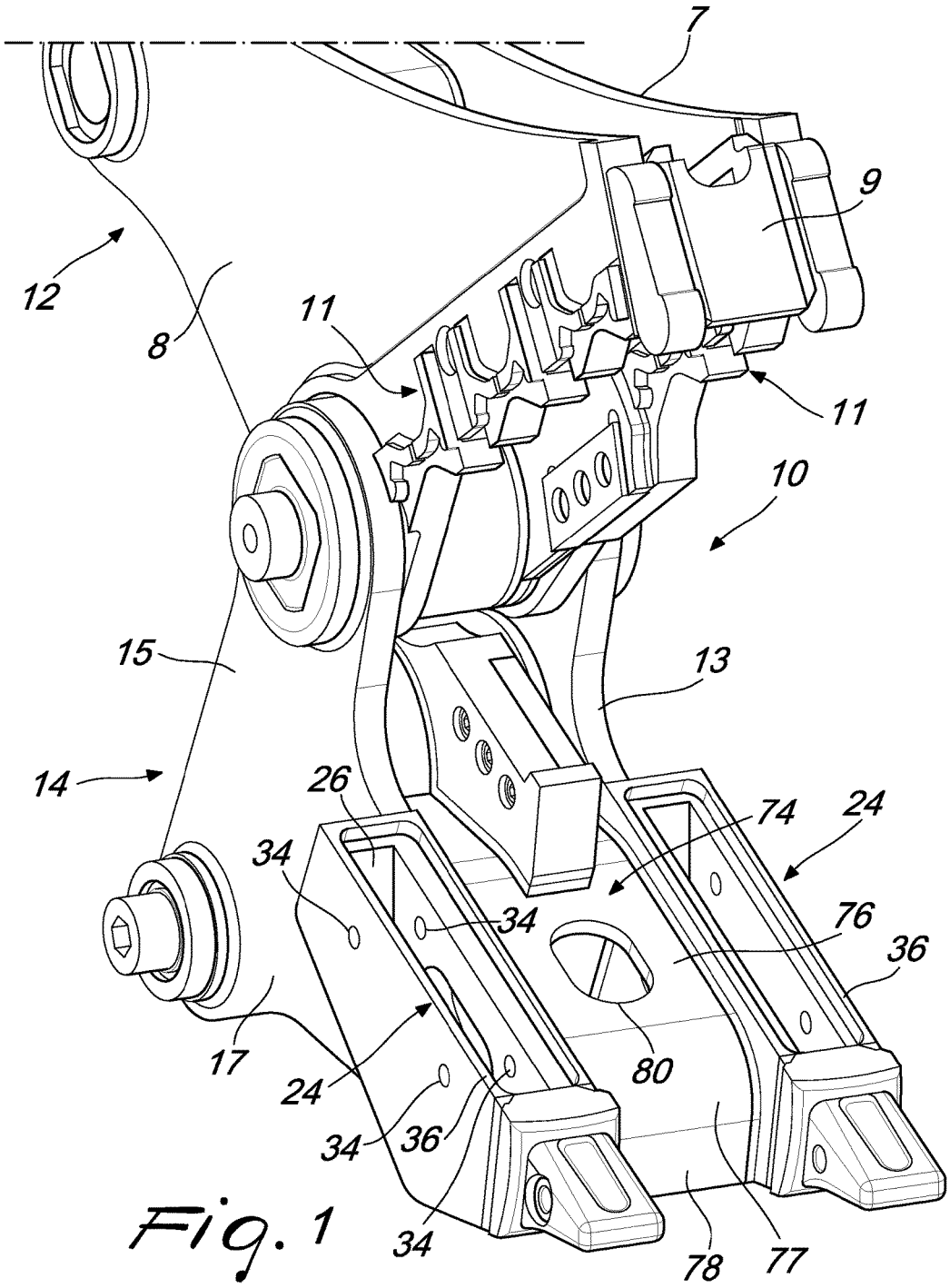
FIG. 1 is an isometric view of a jaw assembly according to the present disclosure.

FIG. 1 illustrates a jaw assembly 10 having a first jaw 12 and a second jaw 14. First jaw 12 and second jaw 14 may be elongated. The first jaw 12 and a second jaw 14 may be connected for mutual relative movement. The first jaw 12 and a second jaw 14 may be connected through a pivot connection at respective ends. First jaw 12 and second jaw 14 may have opposed faces onto which replaceable wear parts may be mounted.

In an embodiment, the first jaw 12 may be the upper jaw and the second jaw 14 may be the lower jaw.

The second jaw 14 may have a first arm 13 and a second arm 15. Arms 13, 15 may be substantially T-shaped. Arms 13, 15 may have respective ends connected through the pivot connection. Opposite the ends connected through the pivot connection arms 13, 15 may be provided with a further connection point. Extending from the portion having the connections, first arm 13 and second arm 15 may have a mounting portion 17 configured for the mounting of the replaceable wear parts. The second jaw 14 may have a seating portion 24 and a support portion 74 for the mounting of the replaceable wear parts.

At least one seating portion 24 may be disposed on the second jaw 14. The seating portion 24 may be positioned at an end of the arm 13, 15 opposite the end connected through the pivot connection. The seating portion 24 may be elongated. Seating portion 24 may be hollow with a side which is formed as a slot 26. The slot 26 may be elongated and may be parallel to the longitudinal axis of the mounting portion 17.

The seating portion 24 may comprise a ledge 36 which surrounds the slot 26. The seating portion 24 may comprise holes 34 extending through opposite walls of the seating portion 24. The holes 34 may detachably accommodate bolts for the mounting of the replaceable wear parts.

In an embodiment, two seating portions 24 may be disposed on the second jaw 14. The seating portions 24 may be disposed at the ends of the arm 13, 15 opposite the ends connected through the pivot connection. The seating portions 24 may be positioned laterally on opposite sides of the second jaw 14. A seating portion 24 may be connected to the first arm 13 and seating portion 24 may be connected to the second arm 15. The seating portions 24 may be substantially parallel to each other.

The support portion 74 may be centrally disposed on the second jaw 14. The support portion 74 may be positioned between the arms 13, 15. The support portion 74 may be positioned between a pair of seating portions 24.

The support portion 74 may have a first contact surface 76 and a second contact surface 78. The first contact surface 76 may be inclined relative to the second contact surface 78. A curved surface 77 may connect the first contact surface 76 and the second contact surface 78.

The first contact surface 76 may lie on a first plane and the ledges 36 that surround the slots 26 of the pair of seating portions 24 may lie on a second plane. The first plane may be substantially parallel to the second plane. The first contact surface 76 may be spaced from the ledges 36 such that the second plane is superposed on the first plane.

The support portion 74 may have an aperture 80. The aperture 80 may be disposed on the first contact surface 76. Aperture 80 may be spaced equidistant from each seating portion 24. The aperture 80 may have any suitable shape. In an embodiment, the aperture 80 may be circular. In an embodiment, the aperture 80 may be elongated with circular ends.

Figure 3:
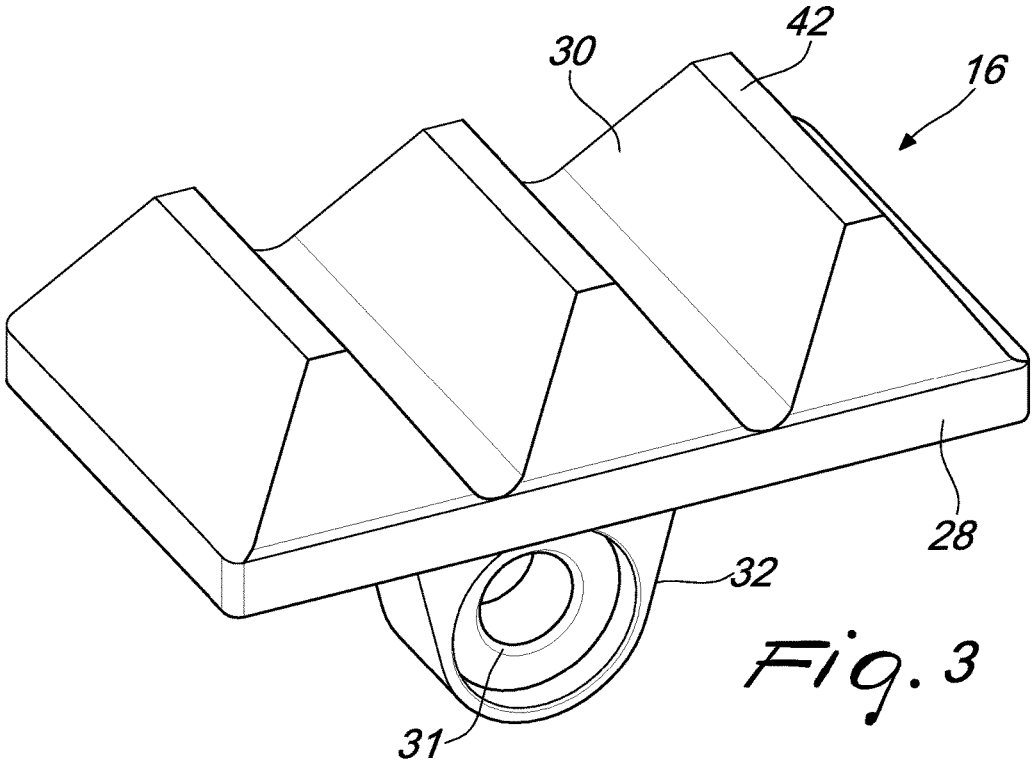
FIG. 3 is an isometric view from above of a first replaceable wear part according to the present disclosure.
Figure 4:
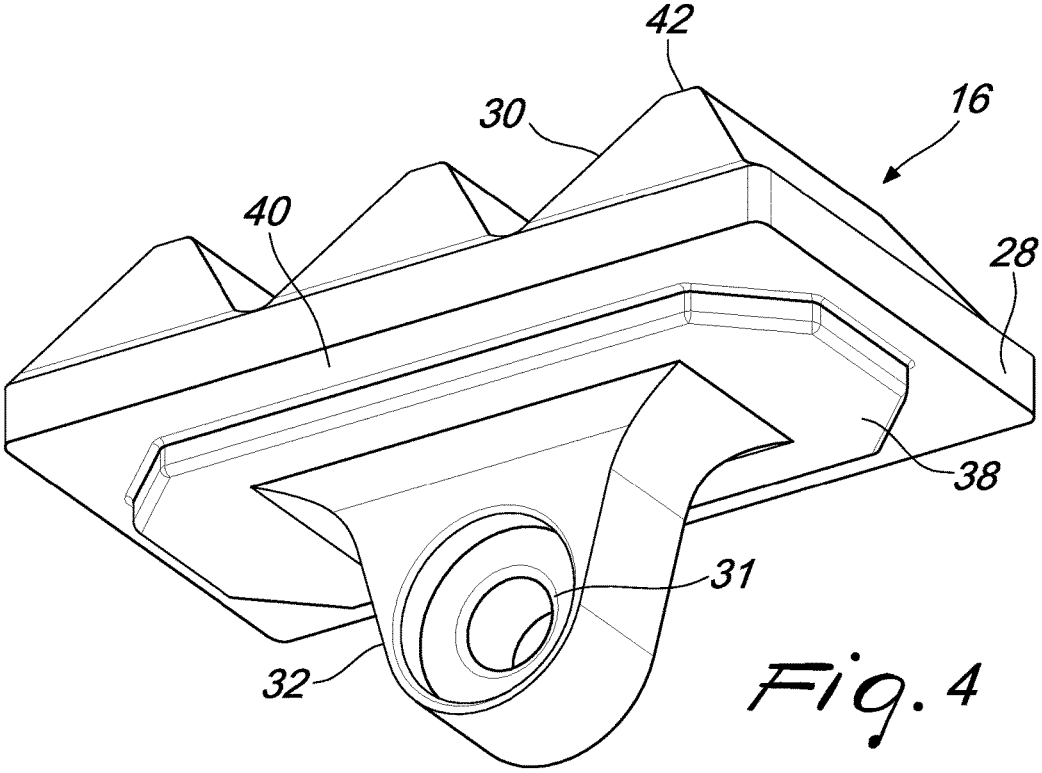
FIG. 4 is an isometric view from below of the first replaceable wear part of FIG. 3.

FIGS. 3 and 4 illustrate a replaceable wear part which is a work module 16 that may be removably mounted to the jaw assembly 10 of a demolition tool. The work module 16 may be removably mounted to the second jaw 14. The work module 16 may be removably mounted in the seating portion 24.

The first work module 16 may comprise a base 28. The base 28 may have a dimension to fit on the ledge 36 of the seating portion 24. The base 28 may be rectangular in shape.

The base 28 may have a dimension such that the perimeter of the base 28 extends beyond the seating portion 24. The base 28 may have a dimension such that the perimeter of the base 28 extends over the first contact surface 76.

The work module 16 may have at least one tooth 30. The tooth 30 may extend from the base 28. The work module 16 may have a mounting element 32. The mounting element 32 may extend from the base 28 in a direction opposite to the tooth 30. The mounting element 32 may be configured for engaging the at least one seating portion 24. The mounting element 32 may have a mounting hole 31. With the work module 16 positioned at the seating portion 24 the mounting hole 31 may be aligned to the hole 34 disposed on the seating portion 24.

The work module 16 may have a plurality of teeth 30. The teeth may be mutually spaced along a longitudinal direction along the base 28. The plurality of teeth 30 may extend laterally across the base 28. The teeth 30 may be mutually substantially parallel. With the work module 16 positioned at the seating portion 24 the longitudinal axes of the teeth 30 may be normal to the longitudinal axis of the slot 26.

Each tooth 30 may have slanted sides and may have a pyramidal shape. The slanted sides of each tooth may be angularly spaced. Each tooth 30 may have a truncated apex 42.

The work module 16 may further comprise a positioning element 38. The positioning element 38 may be interposed between the base 28 and the mounting element 32. The positioning element 38 may be dimensioned to be provided within the perimeter of the base 28. The perimeter of the positioning element 38 may be disposed on the base 28 and within the perimeter of the base 28. In an embodiment, positioning element 38 may have corners thereof cut-away.

The work module 16 may further comprising a shoulder 40 provided between the perimeter of the positioning element 38 and the perimeter of the base element 28. The shoulder 40 may encircle the positioning element 38. The shoulder 40 may be configured to abut and rest on the ledge 36. The shoulder 40 may extend beyond the seating portion 24. The shoulder 40 may extend beyond the ledge 36. The shoulder 40 may extend over the first contact surface 76. The base 28 may have a dimension such that the shoulder 40 may extend beyond the ledge 36 and over the first contact surface 76.

Figure 7:
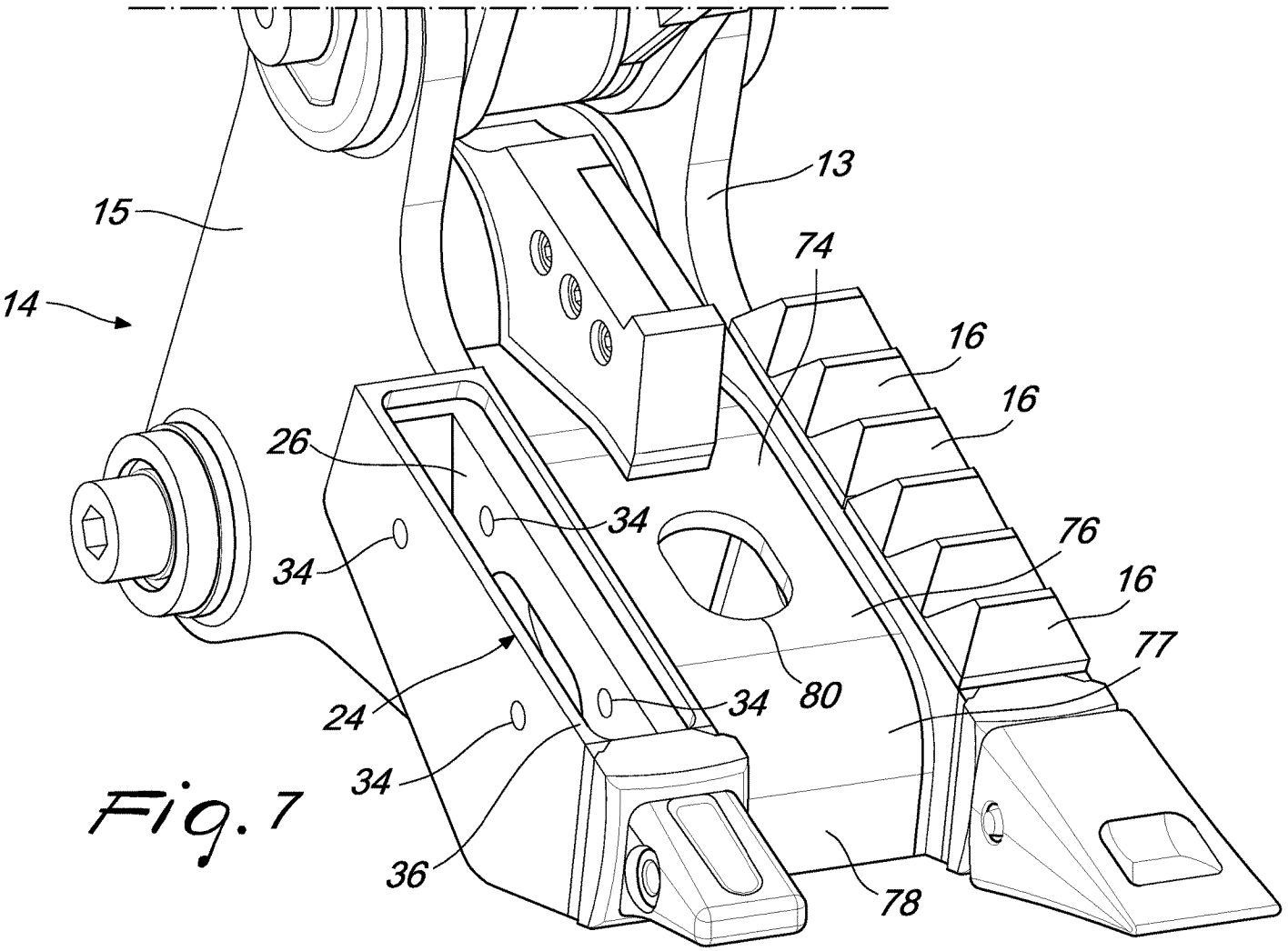
FIG. 7 is an isometric view of the lower jaw of the jaw assembly with the first replaceable wear parts mounted thereon according to the present disclosure.

With reference to FIG. 7, two work modules 16 may be removably mounted to at least one seating portion 24. The work modules 16 may be positioned end to end such that their respective longitudinal axes are coaxial. The bases 28 of the work modules 16 may be supported on the ledge 36. A tooth 30 on each work module 16 may extend laterally across the respective bases 28. The tooth 30 on one work module 16 may be substantially parallel to the tooth on the adjacent work module 16.

Figure 5:
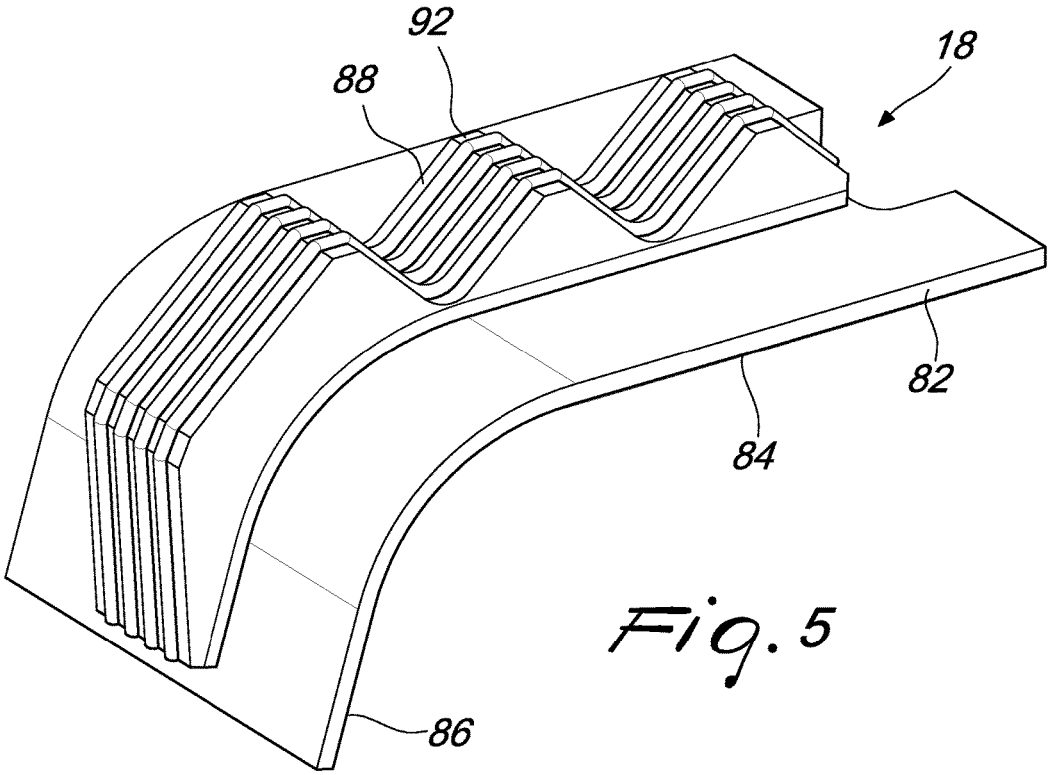
FIG. 5 is an isometric view from above of a second replaceable wear part according to the present disclosure.
Figure 6:
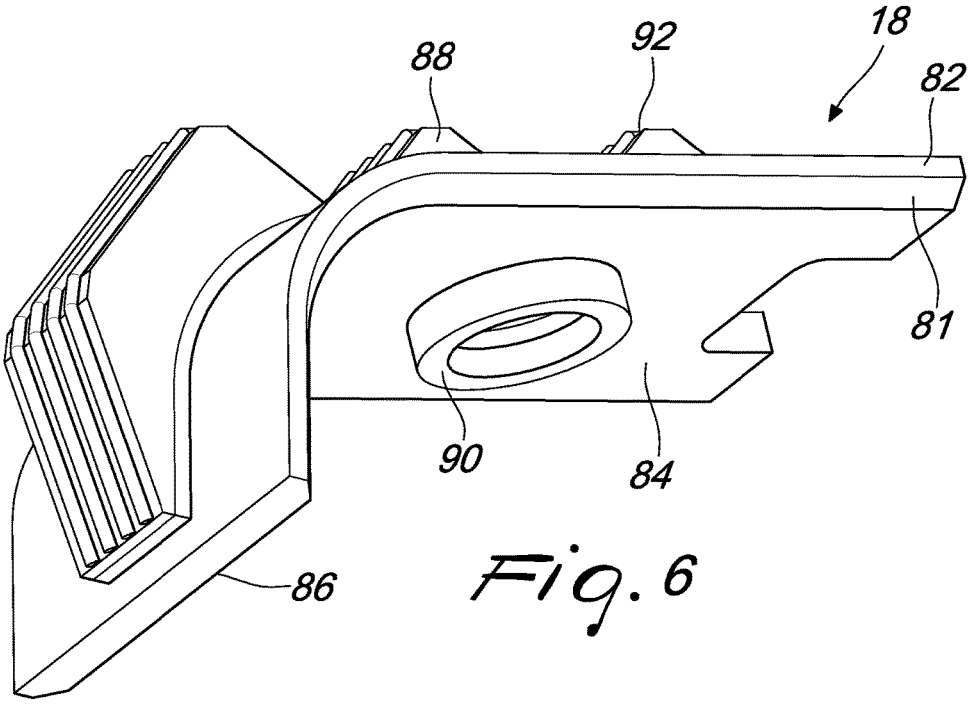
FIG. 6 is an isometric view from below of the second replaceable wear part of FIG. 5.

FIGS. 5 and 6 illustrate a replaceable wear part which is a work plate 18 that may be removably mounted to the jaw assembly 10 of a demolition tool. The work plate 18 may be removably mounted to the second jaw 14.

The work plate 18 may comprise a plate member 82 to abut and rest on the support portion 74. The plate member 82 may have a first plate portion 84 and a second plate portion 86. First plate portion 84 may be inclined relative to second plate portion 86. A curved plate portion may connect first plate portion 84 to second plate portion 86. First plate portion 84 and second plate portion 86 may be supported by first contact surface 76 and second contact surface 78 respectively. The curved plate portion may be supported by the curved surface 77.

The work plate 18 may comprise at least one tooth member 88 extending from the first plate portion 84. The work plate 18 may comprise a plurality of tooth members 88 extending from the first plate portion 84 and the second plate portion 86. The tooth members 88 may be mutually spaced along a longitudinal direction along the plate member 82. A tooth member 88 may extend from the first plate portion 84 to the second plate portion 86. Each tooth 30 may have slanted sides and a substantially pyramidal shape. Each tooth member 88 may have a truncated apex 92.

The work plate 18 may comprise a boss 90 extending from the first plate portion 84 in a direction opposite to the at least one tooth member 88. The boss 90 may engage to the aperture 80. The boss 90 may have a shape and a dimension to fit into the aperture 80. The boss 90 may be circular.

The plate member 82 may have a cut portion 81 extending along the side edges thereof. The cut portion 81 may be positioned on the surface comprising the boss 90.

A modular system for removable mounting of replaceable parts to a jaw assembly 10 of a demolition tool may be composed of the work module 16 and the work plate 18. The work module 16 may have a base 28; at least one tooth 30 extending from the base 28; and a mounting element 32 extending from the base 28 in a direction opposite to the at least one tooth 30 and engaging an at least one seating portion 24 disposed on a second jaw 14 of the jaw assembly 10. The work plate 18 may have a plate member 82 configured for abutting contact with a support portion 74 disposed on a second jaw 14 of the jaw assembly 10, the plate member 82 having mutually inclined first plate portion 84 and second plate portion 86; at least one tooth member 88 extending from the first plate portion 84; and a boss 90 for engagement with an aperture 80 disposed on a first contact surface 76 of the support portion 74, the boss 90 extending from the first plate portion 84 in a direction opposite to the at least one tooth member 88 on the first plate portion 84. When the work module 16 and the work plate 18 are assembled on the second jaw 14 the bases 28 may extend over the plate member 82 to retain the work plate 18 on the second jaw 14.

Figure 8:
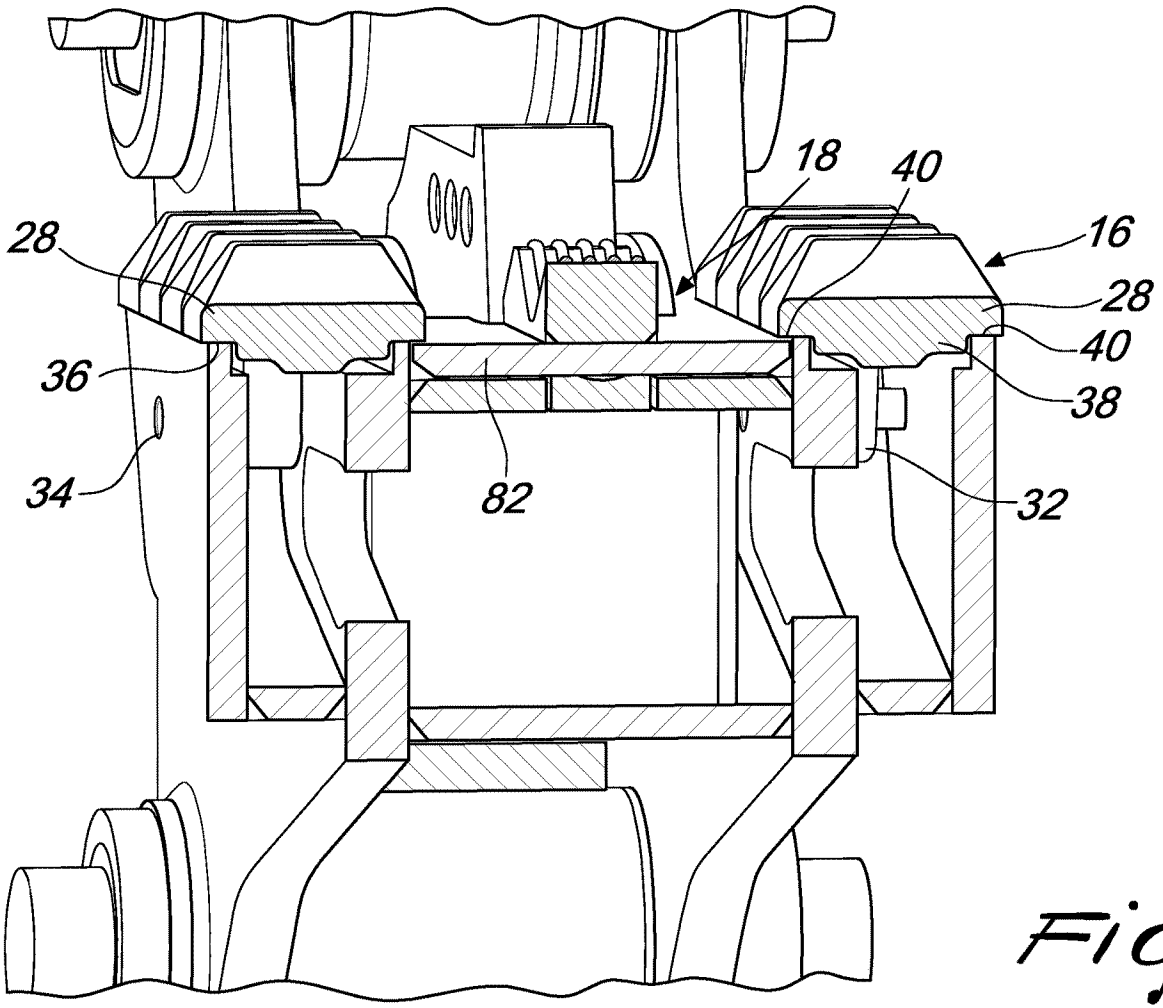
FIG. 8 is a cross-section view through the lower jaw of the jaw assembly with the first and second replaceable wear parts mounted thereon according to the present disclosure.

With reference to FIG. 8, bases 28 may extend over the plate member 82. Bases 28 may extend past the ledges 36 away from the slot 26. The shoulders 40 may extend over the plate member 82. The bases 38 of each work module 16 may extend over opposite sides of the plate member 82. The shoulders 40 of each work module 16 may extend over opposite sides of the plate member 82.

The edges of the bases 28 may act as cantilevers extending over the plate member 82. The base 28 of a work module 16 may extend over a side of the plate member 82. The base 28 of a second work module 16, located in the opposite seating portion 24 may extend over the opposite side of the plate member 82. Vertical movement of the plate member 82 relative to the first contact surface 76 may be prevented by the edges of the bases 28 of the work modules 16.

In an embodiment, the work module 16 may be mounted to the side of the seating portion 24 adjacent the first contact surface 76. Bases 28 may be supported at the side of the seating portion 24 adjacent the first contact surface 76.

The mounting of the modular system may involve mounting the work plate 18 onto the support portion and subsequently mounting at least one work module 16 at each seating portion 24. The work modules 16 may hold the work plate 18 so as to prevent any movement in a direction away from the first plane. The work modules 16 may hold the work plate 18 so as to prevent any movement in a direction away from first contact surface 76. The boss 90 may fit in the aperture 80 and prevent any movement of the plate member 82 in a direction substantially parallel to the first plane. The boss 90 may fit in the aperture 80 and prevent any movement of the plate member 82 in a direction substantially parallel to first contact surface 76.

The work plate 18 may be lowered onto the support portion 74 till the first plate portion 84 and the second plate portion 86 may abut the first contact surface 76 and second contact surface 78 respectively and the boss 90 may fit into the aperture 80.

The work modules 16 may then be inserted into the slot 26 till the shoulders 40 abut the ledges 36. The positioning elements 38 may fit within the inner walls of the seating portions 24. A pin may be inserted through the holes 34 and through the mounting holes 31. The pin may be held in the holes by spring retainers. In an embodiment, a bolt may be inserted through the holes 34 and through the mounting holes 31.

With reference to FIG. 1, the first jaw 12 may have a first plate 7 and a second plate 8 which have respective ends connected through the pivot connection. At the opposite ends of first plate 7 and second plate 8, a front plate 9 may be connected to both plates 7, 8. The first plate 7 and a second plate 8 may each have an active edge 11 configured for the mounting of the replaceable wear parts.

In an embodiment, the first jaw 12 may be composed of a single body that is provided with an active edge.

Figure 2:
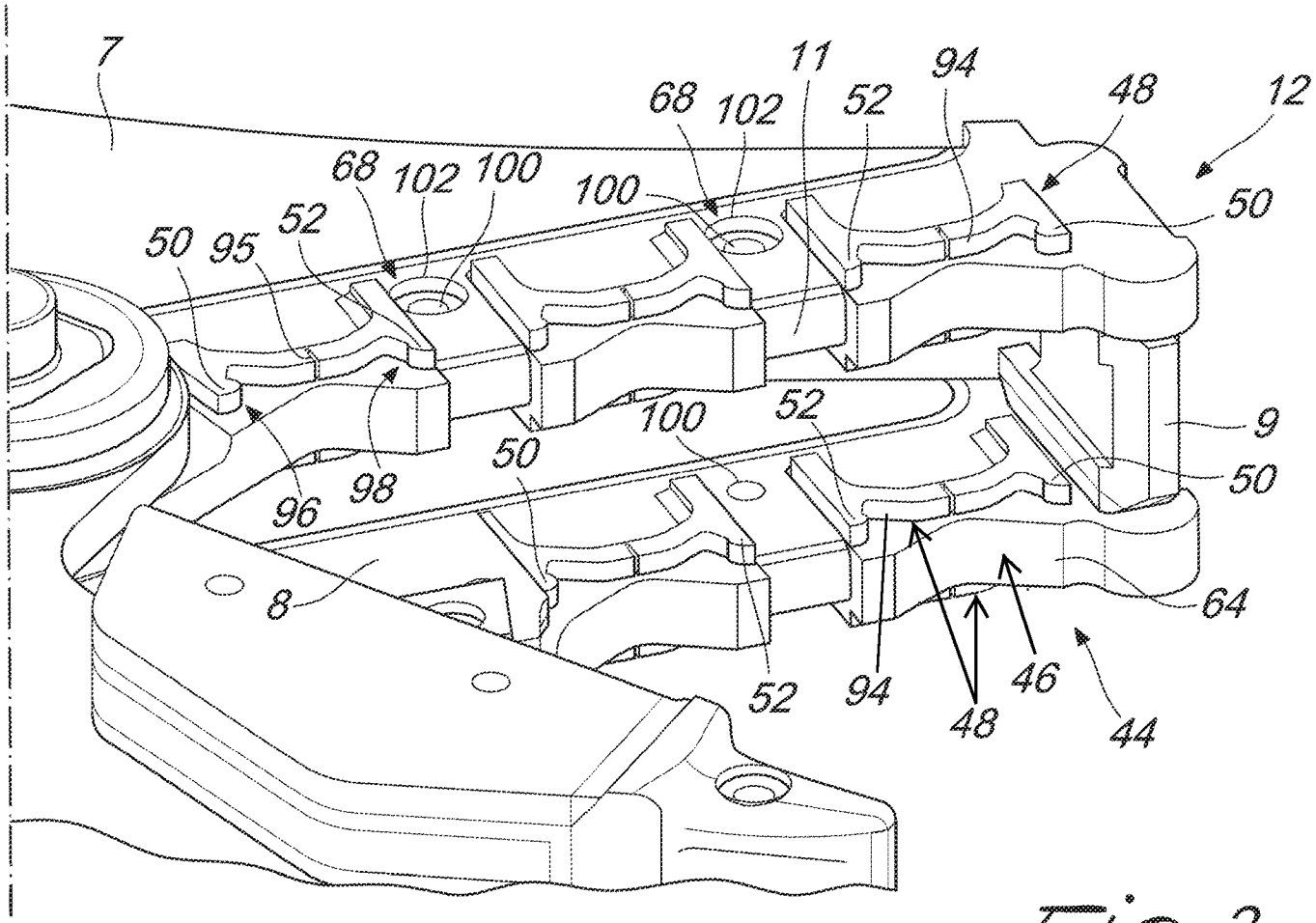
FIG. 2 is an isometric view of the upper jaw of the jaw assembly of FIG. 1.

With reference to FIG. 2, the active edge 11 may have at least one first coupling portion 44. The first coupling portion 44 may comprise an intermediate contact member 46 and a pair of side contact members 48 laterally extending from opposite sides of the intermediate contact member 46.

The intermediate contact member 46 may be an extension from the active edge 11. Intermediate contact member 46 may have width which corresponds to the width of the active edge 11.

The intermediate contact member 46 may have a contact surface 64. Contact surface 64 may be spaced from the active edge 11. Contact surface 64 may be substantially v-shaped with end portions being spaced further from the active edge 11 than a center portion.

In an embodiment, the end portions may have an abutment surface 94 which is parallel to the active edge 11.

Side contact members 48 may protrude from the plates 7, 8 in a direction that is parallel to the active edge 11. Each side contact members 48 may present an abutment surface 94 which is adjacent to the sides of the intermediate contact member 46. Abutment surface 94 may be normal to the sides of the intermediate contact member 46. The contact surface 64 may be spaced from the abutment surface 94. Contact surface 64 and abutment surface 94 may face the same direction. A slot 95 may be provided in each side contact member 48. Slot 95 may extend from the abutment surface 94 in a direction away from the contact surface 64. Slot 95 may be located in the center of the abutment surface 94.

Slot 95 may overcome dimension variations. First protrusion 50 and second protrusion 52 may be formed as plates and welded to opposite sides of the intermediate contact member 46. First protrusion 50 and second protrusions 52 may be welded with a fixed distance to the bore 100 and normal to active edge 11. The slot 95 may enable mounting of first protrusion 50 and second protrusions 52 may be welded without requiring them to be individually attached to the intermediate contact member 46.

The abutment surface 94 may be substantially arcuate shaped. Abutment surface 94 may be formed such that the center is adjacent to the center portion of the contact surface 64. The respective ends of the abutment surface 94 and the contact surface 64 may be nonadjacent.

Each side contact member 48 may comprise a first protrusion 50 spaced from a second protrusion 52. The first protrusion 50 and second protrusion 52 may be located at opposite ends of the abutment surface 94. Each first protrusion 50 and second protrusion 52 may define the limits of the side contact members 48. First protrusion 50 and second protrusion 52 may be remote from the ends of the contact surface 64. First protrusion 50 and second protrusion 52 may extend from the abutment surface 94 to the contact surface 64.

In an embodiment, the free ends of each first protrusion 50 and second protrusion 52 may be in-line with active edge 11.

The first protrusions 50 may have a first engagement surface 96 which faces the second engagement face 98 of the second protrusions 52. The first engagement surface 96 and second engagement surface 98 may comprise curves. The first engagement surface 96 and the second engagement surface 98 may each have a convex curve and a concave curve. The concave curves may be proximate to the abutment surface 94. The convex curves may be distal to the abutment surface 94.

The first engagement surface 96 and the second engagement surface 98 may transit from convex curve to the concave curve from the free end to the abutment surface 94. The degree of change from the convex curve to the concave curve is greater for the first engagement surface 96 relative to the degree of change from the convex curve to the concave curve for the second engagement surface 98. The inflection of the convex curve to the concave curve on the first engagement surface 96 is greater relative to the inflection of the convex curve to the concave curve of the second engagement surface 98.

The convex curve of the first engagement surface 96 has a higher curvature relative to the curvature of the convex curve of the second engagement surface 98.

In an embodiment, convex and concave curves of first engagement surface 96 and second engagement surface 98 may have cross-sections defined by circular arcs.

The active edge 11 of each plate 7, 8 may have a plurality of first coupling portions 44. The first coupling portions 44 may be mutually aligned longitudinally. The first coupling portions 44 may mutually spaced apart.

A first coupling portion 44 may be positioned adjacent to the front plate 9. A first coupling portion 44 may be positioned adjacent to the ends of plate 7, 8 connected through the pivot connection. The side contact members 48 of the first coupling portion 44 adjacent to the front plate 9 may be mirror symmetrical with the side contact members 48 of the first coupling portion 44 adjacent to the pivot connection.

With reference to FIG. 2, the active edge 11 may have at least one second coupling portion 68. The second coupling portion 68 may be adjacent to the at least one first coupling portion 44. The second coupling portion 68 may be contiguous with the at least one first coupling portion 44.

The second coupling portion 68 may comprise of through bore 100. The bore 100 may extend through the plate 7, 8. Bore 100 may be adapted to accommodate bolts for fixing a replaceable wear part. Bore 100 may be located on the plate 7, 8 spaced from the active edge 11. Bore 100 may be provided transverse to the longitudinal axis of the plate 7, 8. At a side of each plate 7, 8 bore 100 may open onto an opening 102. The opening 102 may receive the spring retainers. The pin may be held in the bore 100 by spring retainers. In an embodiment, opening 102 may receive the head of a bolt which is inserted into the bore 100.

The active edge 11 of each plate 7, 8 may have a plurality of second coupling portions 68. The second coupling portions 68 may be mutually aligned longitudinally. The second coupling portions 68 may mutually spaced apart.

The second coupling portions 68 may be interspersed between the first coupling portions 44. The first coupling portions 44 and the second coupling portions 68 may be mutually aligned longitudinally on the active edge 11. The second coupling portions 68 may be bordered by the side contact members 48 of alternate first coupling portions 44.

Figure 9:
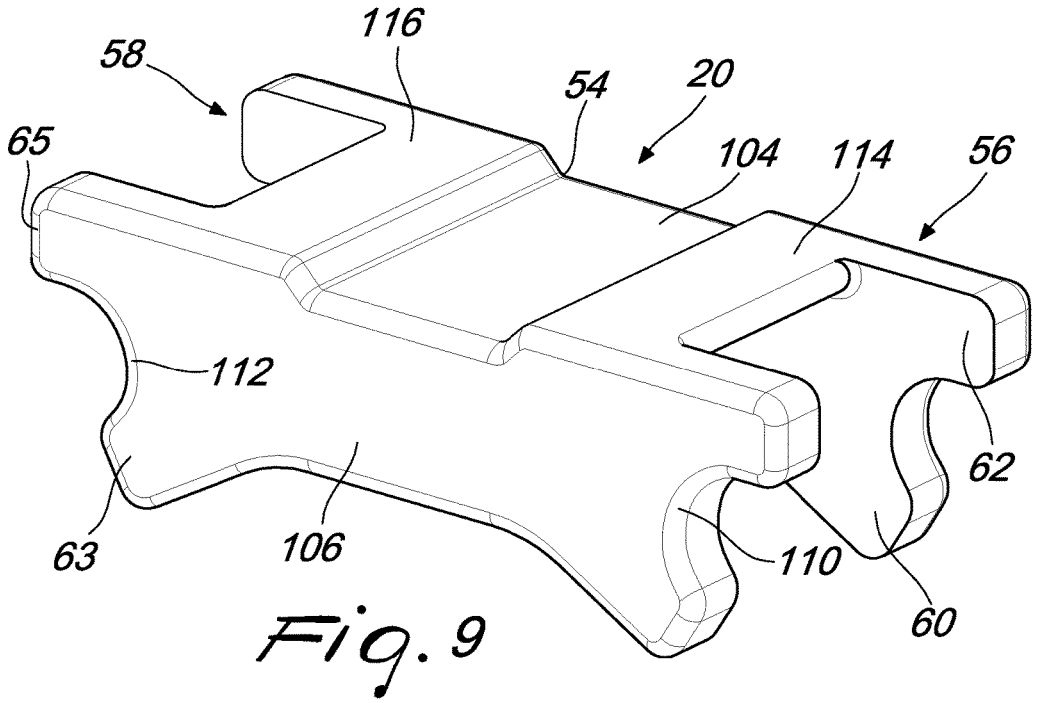
FIG. 9 is an isometric view from above of a third replaceable wear part according to the present disclosure.
Figure 10:
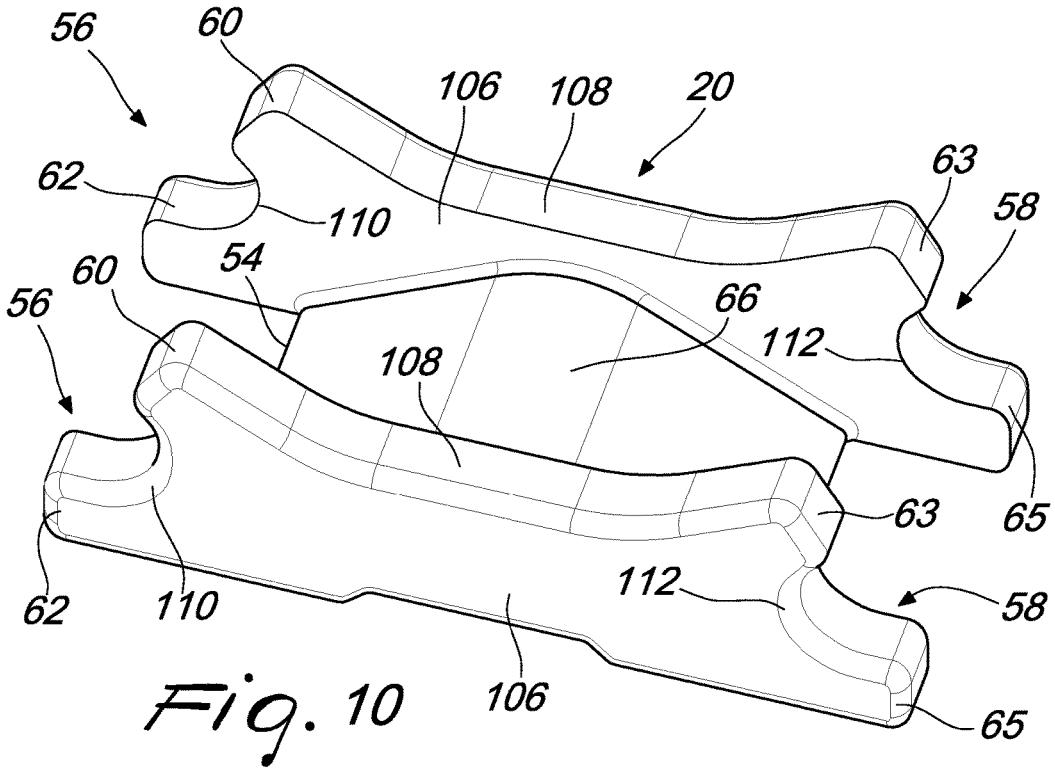
FIG. 10 is an isometric view from below of the third replaceable wear part of FIG. 9.

FIGS. 9 and 10 illustrate a replaceable wear part which is a wear plate 20 that may be removably mounted to the jaw assembly 10 of a demolition tool. The wear plate 20 may comprise a body element 54 that is configured to saddle the first coupling portion 44. The body element 54 may be substantially u-shaped.

Body element 54 may have a central panel 104 connected to a pair of side panels 106. Central panel 104 may be normal to the side panels 106. The central panel 104 may have a notch orientated transverse to the longitudinal axis of the central panel 104. With the wear plate 20 mounted to the first coupling portion 44, the central panel 104 may rest on the contact surface 64. The central panel 104 may have a contact face 66 which is complementarily shaped to the contact surface 64. The contact face 66 may be substantially v-shaped to fit into the contact surface. The center protrusion of the contact face 66 may fit into the center depression of the contact surface 64. The complementarily shaped contact surfaces 64, 66 may limit the axial movement of the wear plate 20 on the first coupling portion 44.

Each side panels 106 may have an abutment edge 108 located opposite the edge connected to the central panel 104. The abutment edges 108 may be shaped to fit onto the abutment surface 94 of the side contact member 48.

A pair of first engagement elements 56 may extend from an end of the body element 54 for engaging to first protrusions 50 provided on the at least one first coupling portion 44. First engagement elements 56 may extend in a direction substantially away from the central panel 104. The pair of first engagement elements 56 may be spaced apart on the body element 54. The pair of first engagement elements 56 may be mutually substantially parallel. The pair of first engagement elements 56 may be mirror symmetrical. First engagement elements 56 may be disposed on the side panels 106 and on the central panel 104.

Each first engagement element 56 may comprise a pair of bifurcate fingers 60, 62. First fingers 60 may be angularly spaced relative to second fingers 62. First fingers 60 may have an angular spacing of 10° to 50° relative to second fingers 62. Preferably, first fingers 60 may have an angular spacing of 15° to 35° relative to second fingers 62. Preferably, first fingers 60 may have an angular spacing of 20° to 40° relative to second fingers 62. Preferably, first fingers 60 may have an angular spacing of 25° to 45° relative to second fingers 62. Preferably, first fingers 60 may have an angular spacing of 30° relative to second fingers 62.

With an angular spacing of 30° the wear plate 20 may be retained in engagement to first protrusions 50 and to prevent the fingers 60, 62 from becoming to long and small which may increase the risk of breaking. With an angle of more than 50° the wear plate 20 may not be retained in engagement to first protrusions 50. A first groove 110 may be formed between each pair of bifurcate fingers 60, 62. First grooves 110 may have cross-sections defined by circular arcs. The circular arcs may be opposite the respective openings. First grooves 110 may receive first protrusions 50. First grooves 110 may have dimensions and shapes to accommodate the first protrusions 50.

Each first finger 60 may be provided on the side panel 106. First finger 60 may be inclined relative to central panel 106. The longitudinal axis of first finger 60 may be inclined relative to the longitudinal axis of central panel 104. The longitudinal axis of first finger 60 may be inclined relative to the longitudinal axis of second finger 62. The side of first finger 60 opposite the side bordering the first groove 110 may form the side of the abutment edge 108.

Each second finger 62 may be disposed at the connection of side panel 106 and central panel 104. Second finger 62 may partially extend from side panel 106 and may partially extend from central panel 104. The longitudinal axis of second finger 62 may be parallel to the longitudinal axis of central panel 104.

The sides of second fingers 62 opposite the sides bordering the first grooves 110 may be planar with a surface of the central panel 104. A first retainment zone 114 may be formed by a surface at the end portion of the central panel 104 and the side of second finger 62 which are mutually planar. The first retainment zone 114 may be bordered by the notch.

A pair of second engagement elements 58 may extend from an end of the body element 54 for engaging to second protrusions 52 provided on the at least one first coupling portion 44. Second engagement elements 58 may extend in a direction substantially away from the central panel 104. Second engagement elements 58 may extend in a direction opposite to the direction of extension of the first engagement elements 56. The pair of second engagement elements 58 may be spaced apart on the body element 54. The pair of second engagement elements 58 may be mutually substantially parallel. The pair of second engagement elements 58 may be mirror symmetrical. Second engagement elements 58 may be disposed on the side panels 106 and on the central panel 104.

Each second engagement element 58 may comprise a pair of bifurcate branches 63, 65. First branches 63 may be angularly spaced relative to second branches 65. First branches 63 may have an angular spacing of 10° to 50° relative to second branches 65. Preferably, first branches 63 may have an angular spacing of 15° to 35° relative to second branches 65. Preferably, first branches 63 may have an angular spacing of 20° to 40° relative to second branches 65. Preferably, first branches 63 may have an angular spacing of 25° to 45° relative to second branches 65. Preferably, first branches 63 may have an angular spacing of 30° relative to second branches 65.

With an angular spacing of 30° the wear plate 20 may be retained in engagement to second protrusions 52 and to prevent the branches 63, 65 from becoming to long and small which may increase the risk of breaking. With an angle of more than 50° the wear plate 20 may not be retained in engagement to second protrusions 52.

The bifurcate fingers 60, 62 may have the same angular spacing as the bifurcate branches 63, 65. In an embodiment, the bifurcate fingers 60, 62 may have a smaller angular spacing than the bifurcate branches 63, 65.

A second groove 112 may be formed between each pair of bifurcate branches 63, 65. Second grooves 112 may have cross-sections defined by circular arcs. The circular arcs may be opposite the respective openings. Second grooves 112 may receive second protrusions 52. Second grooves 112 may have dimensions and shapes to accommodate the second protrusions 52.

Second grooves 112 may have the same dimension as first grooves 110. Second grooves 112 may have the same diameter as first grooves 110. In an embodiment, second grooves 112 may have a greater dimension relative to first grooves 110. Second grooves 112 may have a diameter that is greater relative to the diameter of first grooves 110.

Each first branch 63 may be provided on the side panel 106. First branch 63 may be inclined relative to central panel 106. The longitudinal axis of first branch 63 may be inclined relative to the longitudinal axis of central panel 106. The longitudinal axis of first branch 63 may be inclined relative to the longitudinal axis of second finger 65. The side of first branch 63 opposite the side bordering the may form the first groove 110 may form the side of the abutment edge 108.

Each second branch 65 may be disposed at the connection of side panel 106 and central panel 104. Second branch 65 may partially extend from side panel 106 and may partially extend from central panel 104. The longitudinal axis of second branch 65 may be parallel to the longitudinal axis of central panel 106.

The sides of second branches 65 opposite the sides bordering the first grooves 110 may be planar with a surface of the central panel 104. A second retainment zone 116 may be formed by a surface at the end portion of the central panel 104 and the side of second branch 65 which are mutually planar. The second retainment zone 116 may be bordered by the notch. Second retainment zone 116 may be formed opposite the first retainment zone 114.

Figure 12:
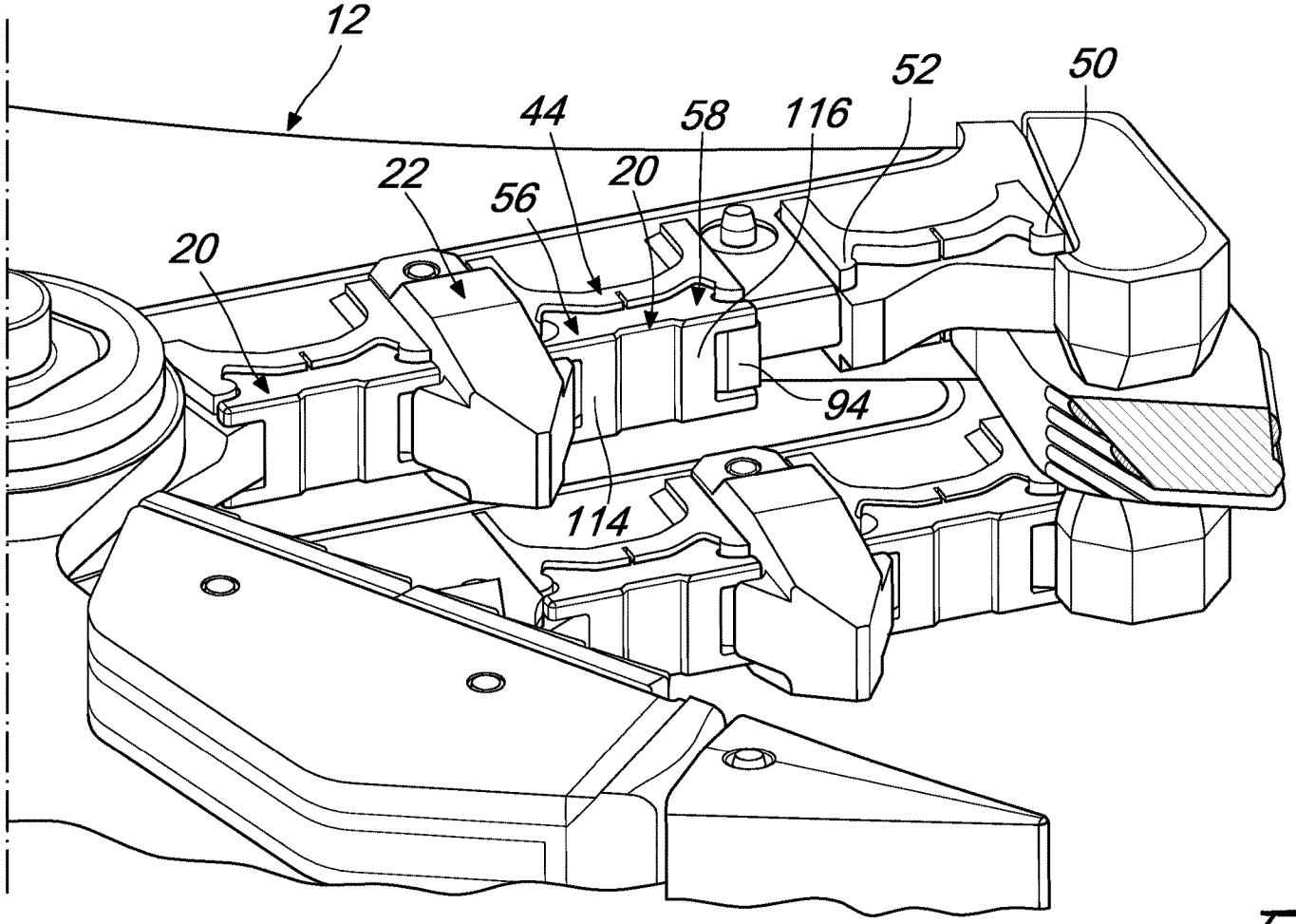
FIG. 12 is an isometric view of the upper jaw of the jaw assembly with the third and fourth replaceable wear parts mounted thereon according to the present disclosure.

FIG. 12 illustrates the wear plate 20 mounted on the first coupling portion 44. First engagement elements 56 and second engagement elements 58 may extend along the side of the intermediate contact member 46. The first retainment zone 114 may be planar with an abutment surface 94 of the intermediate contact member 46. The second retainment zone 116 may be planar with an abutment surface 94 of the intermediate contact member 46.

Figure 11:
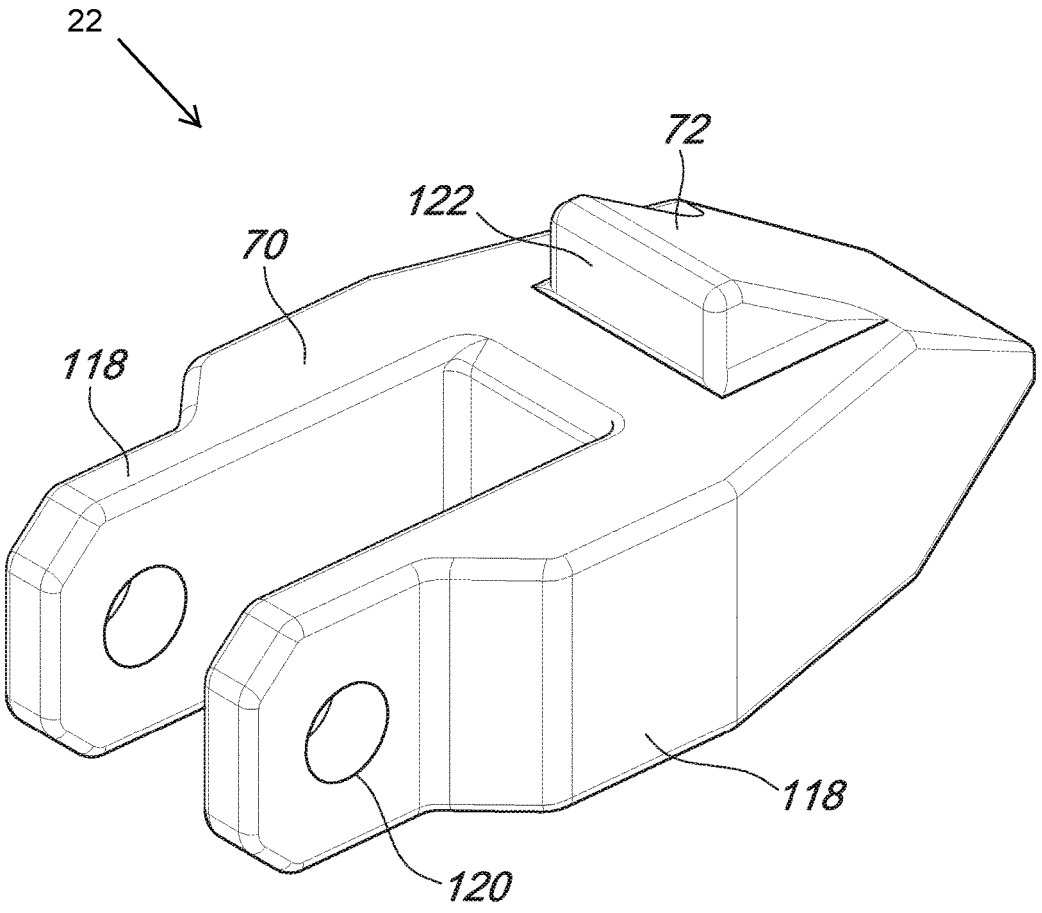
FIG. 11 is an isometric view of a fourth replaceable wear part according to the present disclosure.

FIG. 11 illustrates a replaceable wear part which is an active module 22 that may be removably mounted to the jaw assembly 10 of a demolition tool. The active module 22 may comprise a body member 70 that is configured to be mountable to the at least one second coupling portion 68. Body member 70 may be substantially U-shaped to straddle the intermediate contact member 46. Legs 118 may extend from the body member 70. Legs 118 may extend longitudinally from the body member 70. Legs 118 may be provided with through bores 120 for receiving pins for coupling to the second coupling portion 68.

Active module 22 may have at least one brace 72 disposed on the body member 70. Brace 72 may protrude laterally from the body member 70. Brace 72 may be disposed on the member 70 spaced away from the legs 118. Brace 70 may have a substantially triangular shape. Brace 70 may have a triangular cross-section.

In an embodiment, brace 70 may be a planar extension. Brace 70 may have a rectangular cross-section.

Brace 72 may have a retainment face 122 which faces the direction of extension of legs 118. Retainment face 122 may be planar. Retainment face 122 may have a dimension such that with the active module 22 mounted at the second coupling portion 68 the brace 72 may extend over the wear plate 20. Brace 72 may extend over the second engagement elements 58. Brace 72 may extend over the first engagement elements 56.

With reference to FIG. 12, brace 72 may extend over the second engagement elements 58. Brace 72 may extend over the first engagement elements 56. Retainment face 122 may contact the abutment surface 94 and the first retainment zone 114. Retainment face 122 may contact the abutment surface 94 and the second retainment zone 116.

The retainment face 112 may engage the second engagement elements 58 to retain the wear plate 20 on the first jaw 12. The retainment face 112 may engage the second retainment zone 116 to retain the wear plate 20 on the first jaw 12. The retainment face 112 may engage the first engagement elements 56 to retain the wear plate 20 on the first jaw 12. The retainment face 112 may engage the first retainment zone 114 to retain the wear plate 20 on the first jaw 12.

In an embodiment, a pair of braces 72 may be provided on opposite sides of the body member 70. The braces 72 may extend from the body member 70 in opposite directions. The braces 72 may be configured to extend over the first engagement elements 56 and the second engagement elements 58 of alternate wear plates 20. The braces 72 may be configured to extend over the second engagement elements 58 of alternate wear plates 20.

A modular system for removable mounting of replaceable parts to a jaw assembly 10 of a demolition tool may be composed of the wear plate 20 and the active module 22. The wear plate 20 may comprise a body element 54 configured to saddle an at least one first coupling portion 44 disposed on a first jaw 12 of the jaw assembly 10; a pair of spaced apart first engagement elements 56 extending from an end of the body element 54 for engaging to first protrusions 50 provided on the at least one first coupling portion 44; and a pair of spaced apart second engagement elements 58 extending longitudinally from an opposite end of the body element 54 for engaging to the second protrusions 52 provided on the at least one first coupling portion 44. The active module 22 may comprise a body member 70 configured to be mountable to the at least one second coupling portion 68 disposed on a first jaw 12 adjacent to the at least one first coupling portion 44; at least one brace 72 disposed on a side of the body member 70 and configured to extend over the second engagement elements 58. When the wear plate 20 and the active module 22 are assembled on the first jaw 24 a brace 72 may extend over the second engagement elements 58 to retain the wear plate 20 on the first jaw 12.

In an embodiment, a pair of braces 72 may be disposed on opposite sides of the body member 70. The braces 72 may be configured to extend over the first engagement elements 56 and the second engagement elements 58 of alternate wear plates 20. The braces 72 may be configured to extend over the second engagement elements 58 of alternate wear plates 20.

The mounting of the modular system may involve mounting the wear plate 20 onto the first coupling portion 44 and subsequently mounting at least one active module 22 at second coupling portion 68.

The wear plate 20 may be mounted on the first coupling portion 44. Wear plate 20 may be positioned such that the first engagement elements 56 may be pointed towards the firsts protrusions 50. Wear plate 20 is moved towards first coupling portion 44 and the first engagement elements 56 contact with the first protrusions 50. The first fingers 60 may contact the concave curves of the first engagement surfaces 96. The convex curves of first engagement surfaces 96 may fit into the first grooves 110. The second fingers 62 may engage the free ends of the first protrusions 50. Side panels 106 may contact the sides of the intermediate contact member 46.

Figure 13:
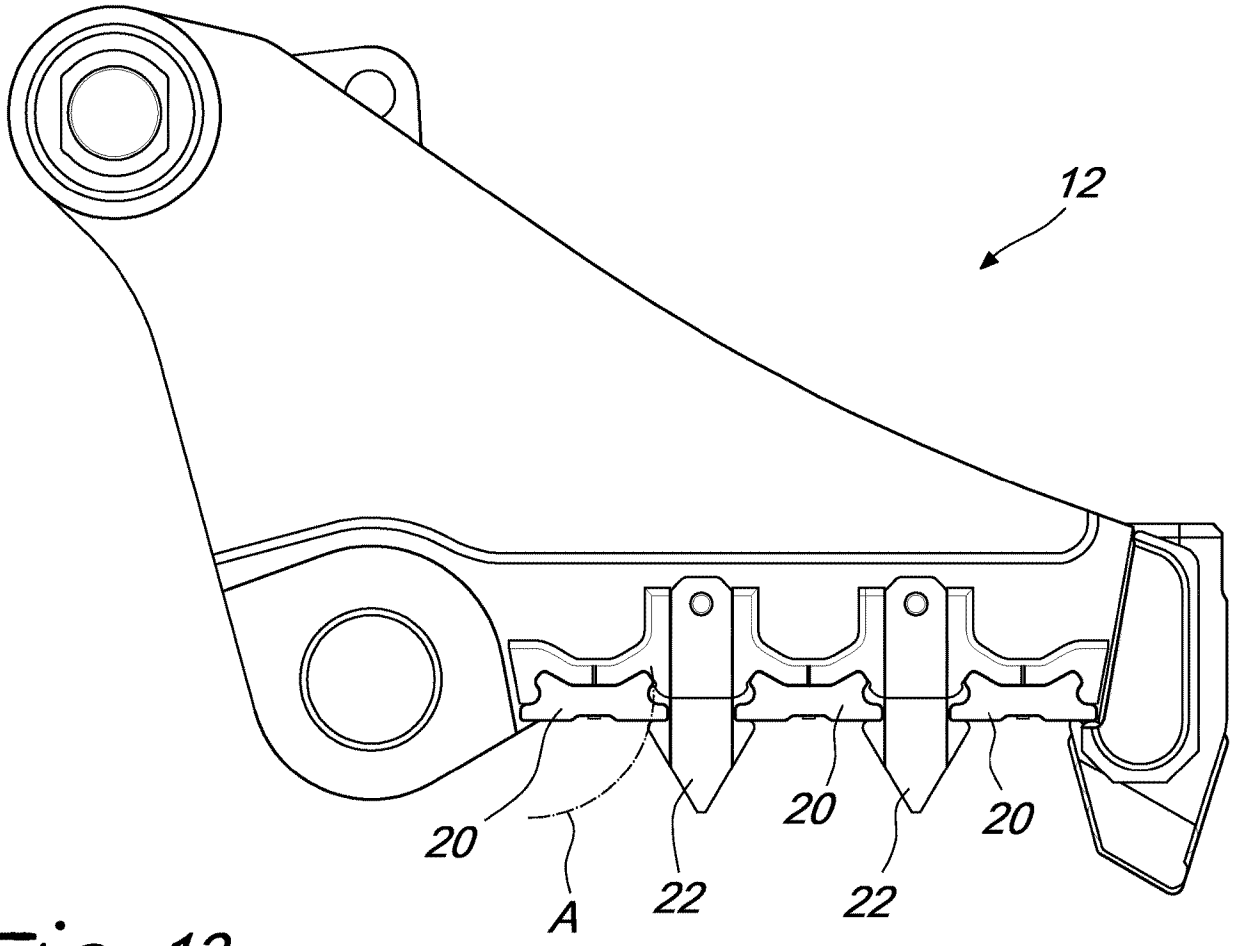
FIG. 13 is a side view of the upper jaw of the jaw assembly with the third and fourth replaceable wear parts mounted thereon according to the present disclosure.

Once, the first engagement elements 56 are engaged with the firsts protrusions 50, the wear plate 20 may be rotated onto the first coupling portion 44 along the line A as illustrated in FIG. 13. Line A may be concentric with the convex curve of first engagement surfaces 96. Wear plate 20 may be rotated away from the first coupling portion 44 along the line A as illustrated in FIG. 13 when being removed therefrom.

The convex curves may rotate in the first grooves 110 relative to the side contact members 48. The first fingers 60 may rotate in concave curves of the first engagement surfaces 96 side contact members 48. Side panels 106 may slide against the sides of the intermediate contact member 46.

As wear plate 20 rotates about the convex curves of the first engagement surfaces 96 of the first protrusion 50 the second engagement elements 58 move into contact with the second engagement surfaces 98 of the second protrusions 52. The first branches 63 may slide past the convex curves of the second engagement surfaces 98 to contact the concave curves thereof. The second branches 65 may move into contact the free ends of the second protrusions 52. The second branches 65 may contact and rest on the convex curves of the second engagement surfaces 98. The abutment edges 108 of the side panels 106 move into contact with the respective abutment surfaces 94 of the side contact members 48. The contact face 66 of the wear plate 20 may fit into the contact surface 64 of the intermediate contact member 46.

After, the wear plate 20 is mounted at the first coupling portion 44, the active module 22 is moved into the second coupling portion 68. The body member 70 straddles the active edge 11 and the legs 118 are positioned such that the bores 120 are aligned with the bores 100. Bolts may be inserted through bores 120 and bores 100 so as to hold the active module 22 at the second coupling portion 68. With the active module 22 mounted at least one brace 72 may be disposed on a side of the body member 70 and may extend over the second engagement elements 58.

Figure 14:
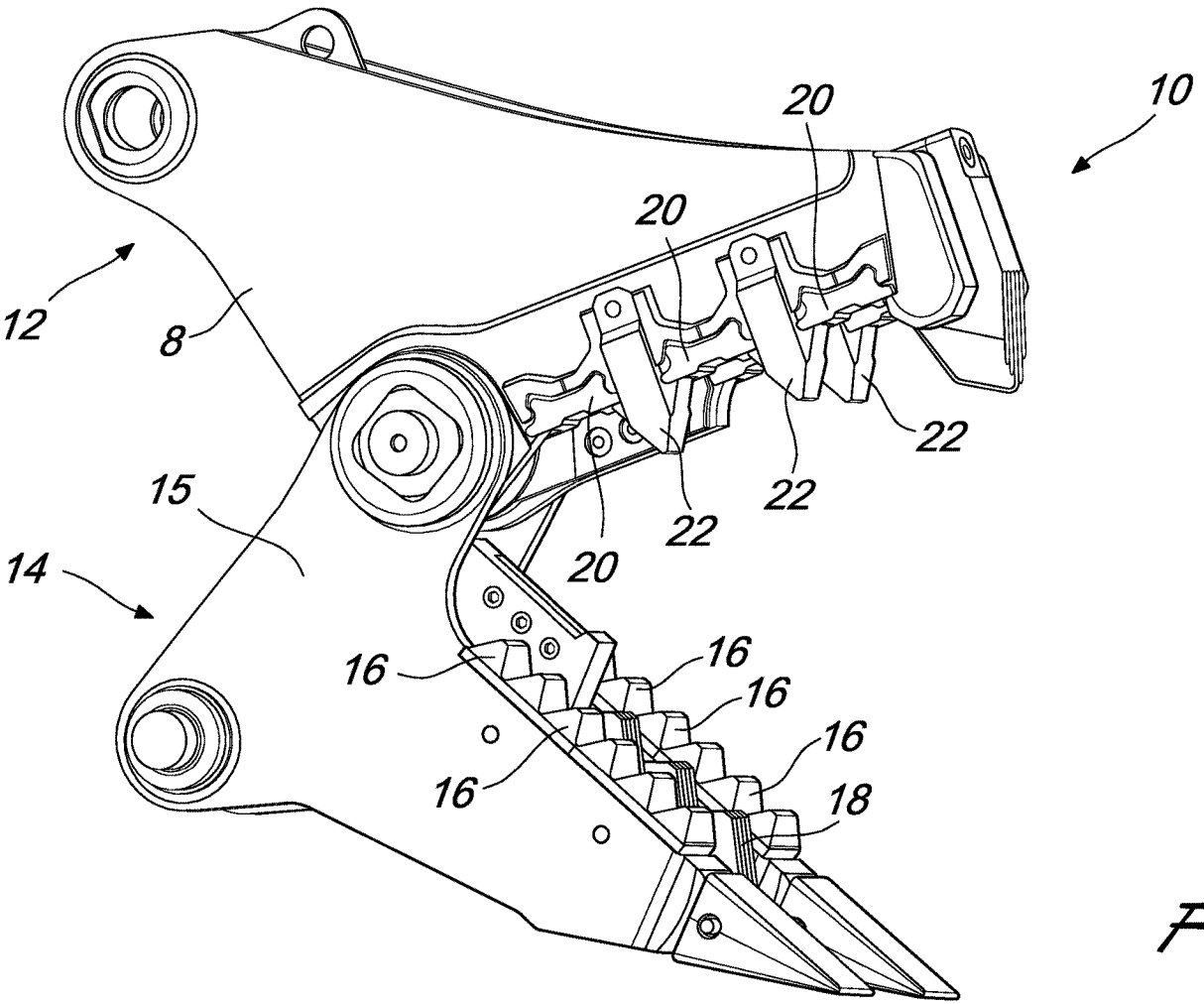
FIG. 14 is an isometric view of the jaw assembly with the first, second, third and fourth replaceable wear parts mounted thereon according to the present disclosure.

FIG. 14 illustrates a jaw assembly 10 having mounted thereon the replaceable wear parts represented by the work module 16, the work plate 18, the wear plates 20 and the active modules 22.

The skilled person would appreciate that foregoing embodiments may be modified or combined to obtain the jaw assembly 10 and the replaceable wear parts 16, 18, 20, 22 of the present disclosure.

INDUSTRIAL APPLICABILITY

This disclosure describes a jaw assembly 10 and replaceable wear parts. The replaceable wear parts may be mounted to the jaw assembly 10 of a demolition tool such as multi-processors, pulverizers, crushers and other demolition tools that may have a jawset or grapple tine which have closing movements. The replaceable wear parts may be mounted to the corresponding support portions of the jaw assembly 10. The replaceable wear parts may shield the jaw assembly 10 from wear during demolition operations such as crushing or cutting of materials. The replaceable wear parts may be made of materials suitable for the crushing or cutting operations.

The replaceable wear parts may be easily and efficiently mounted on and dismounted from jaw assembly. Once the replaceable wear parts are spent due to operation of the demolition tool, the modules may be easily replaced with a substitute replaceable modules.

The replaceable wear parts 18, 20 may be removably mounted on the jaw assembly 10 without the use of bolts or pins.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by references signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The disclosures in European Patent Application No. 12171210.3 from which this application claims priority are incorporated herein by reference.

The invention claimed is:

1. A jaw assembly for a demolition tool, the jaw assembly comprising:

a first jaw having a back end disposed opposite a front end, a longitudinal direction of the first jaw extending from the back end toward the front end;

a second jaw operatively coupled to the first jaw via a pivot connection located at the back end of the first jaw;

at least one first coupling portion disposed on the first jaw, the at least one first coupling portion comprising:

an intermediate contact member; and a pair of side contact members laterally extending from opposite sides of the intermediate contact member, one side contact member of the pair of side contact members protruding away from another side contact member of the pair of side contact members along a transverse direction, the transverse direction being transverse to the longitudinal direction, each side contact member having a first protrusion spaced apart from a second protrusion, the first protrusion and the second protrusion extending away from a respective side contact member of the pair of side contact members along a normal direction and protruding away from the intermediate contact member along the transverse direction, the normal direction being perpendicular to both the longitudinal direction and the transverse direction, the normal direction facing the second jaw;

a wear plate removably coupled to the at least one first coupling portion, the wear plate comprising:

a body element saddling the intermediate contact member;

a pair of spaced apart first engagement elements extending from a first end of the body and being engaged with the first protrusions; and a pair of spaced apart second engagement elements extending from a second end of the body and being engaged with the second protrusions, the first end of the body being opposite the second end of the body;

at least one second coupling portion adjacent to the at least one first coupling portion; and an active module removably coupled to the at least one second coupling portion, the active module comprising:

a body member mounted to the at the least one second coupling portion; and a pair of braces disposed on opposite sides of the body member, wherein a brace of the pair of braces extends over the second engagement elements, such that the wear plate is captured between the active module and the at least one first coupling portion.

2. The jaw assembly of claim 1, wherein each first engagement element comprises mutually angularly spaced bifurcate fingers and each second engagement element comprises mutually angularly spaced bifurcate branches.

3. The jaw assembly of claim 2, wherein the bifurcate fingers have a same angular spacing as the bifurcate branches.

4. The jaw assembly of claim 2, wherein the bifurcate fingers have a smaller angular spacing than the bifurcate branches.

5. The jaw assembly of claim 1, wherein each first protrusion has a first convex curve with a higher curvature relative to a second convex curve of each second protrusion.

6. The jaw assembly of claim 1, wherein convex curves of the first protrusion and the second protrusion have cross-sections defined by circular arcs.

7. The jaw assembly of claim 1, wherein the first protrusion faces the second protrusion.

8. The jaw assembly of claim 1, wherein the intermediate contact member has a v-shaped contact surface for coupling to the body having a complementarily shaped contact face.

9. The jaw assembly of claim 1, wherein the pair of spaced apart first engagement elements of the wear plate and the pair of spaced apart second engagement elements of the wear plate extend along sides of the intermediate contact member.

10. The jaw assembly of claim 1, further comprising:

a plurality of wear plates including the wear plate; and a plurality of active modules including the active module, wherein the at least one first coupling portion includes a plurality of first coupling portions, wherein the at least one second coupling portion includes a plurality of second coupling portions, wherein the plurality of wear plates are removably coupled to the plurality of first coupling portions, wherein the plurality of active modules are removably coupled to the plurality of second coupling portions, and wherein the plurality of wear plates alternate with the plurality of active modules.

11. A wear plate for removable mounting to a jaw assembly of a demolition tool, the wear plate comprising:

a body element configured to saddle at least one first coupling portion disposed on a first jaw of the jaw assembly;

a pair of first engagement elements extending from a first end of the body element for engaging with first protrusions provided on the at least one first coupling portion, the pair of first engagement elements being spaced apart from one another along a transverse direction; and a pair of second engagement elements extending from a second end of the body element for engaging with second protrusions provided on the at least one first coupling portion, the pair of second engagement elements being spaced apart from one another along the transverse direction, the first end of the body element being opposite the second end of the body element, a longitudinal direction of the body element extending from the first end toward the second end, the longitudinal direction being perpendicular to the transverse direction, wherein each first engagement element of the pair of first engagement elements comprises mutually angularly spaced bifurcate fingers, and each second engagement element of the pair of second engagement elements comprises mutually angularly spaced bifurcate branches, wherein the bifurcate fingers of each first engagement element includes a first finger and a second finger, wherein the bifurcate branches of each second engagement element includes a first branch and a second branch, wherein the second finger of each first engagement element and the second branch of each second engagement element are disposed between the first finger of one first engagement element and the first branch of one second engagement element along the longitudinal direction, wherein the first finger of each first engagement element projects away from and beyond the body element along the longitudinal direction, and wherein the first branch of each second engagement element projects away from and beyond the body element along the longitudinal direction, and the first branch of each second engagement element projects away from the first finger of each first engagement element along the longitudinal direction.

12. The wear plate of claim 11, wherein the body element has a v-shaped contact face for coupling with an intermediate contact member of the first coupling portion.

13. The wear plate of claim 11, wherein the bifurcate fingers have a same angular spacing as the bifurcate branches.

14. The wear plate of claim 11, wherein an end of the second finger of each first engagement element and an end of the second branch of each second engagement element all project away from the body element along a normal direction of the wear plate, the normal direction being perpendicular to both the longitudinal direction and the transverse direction.

15. The wear plate of claim 11, wherein the first finger of each first engagement element includes a first finger side and a second finger side that extend from the body element toward a tip of each respective first finger, the first finger side facing away from the second finger side along a normal direction, wherein the first branch of each second engagement element includes a first branch side and a second branch side that extend from the body element toward a tip of each respective first branch, the first branch side facing away from the second branch side along the normal direction, and wherein the normal direction is perpendicular to both the longitudinal direction and the transverse direction.

16. A modular system for removable mounting of replaceable parts to a jaw assembly of a demolition tool, the modular system comprising:

a wear plate comprising:

a body element configured to saddle at least one first coupling portion disposed on a first jaw of the jaw assembly;

a pair of spaced apart first engagement elements extending from a first end of the body element for engaging with first protrusions provided on the at least one first coupling portion; and a pair of spaced apart second engagement elements extending longitudinally from a second end of the body element for engaging with second protrusions provided on the at least one first coupling portion, the first end of the body element being opposite the second end of the body element; and an active module comprising:

a body member configured to be mountable to at least one second coupling portion disposed on the first jaw adjacent to the at least one first coupling portion; and at least one brace disposed on a side of the body member and extending over the second engagement elements, such that when the wear plate and the active module are assembled on the first jaw, the wear plate is captured between the active module and the at least one first coupling portion.

17. The modular system of claim 16, wherein each first engagement element comprises mutually angularly spaced bifurcate fingers and each second engagement element comprises mutually angularly spaced bifurcate branches.

18. The modular system of claim 17, wherein the bifurcate fingers have a same angular spacing as the bifurcate branches.

19. The modular system of claim 16, wherein each first protrusion has a first convex curve with a higher curvature relative to a second convex curve of each second protrusion.

20. The modular system of claim 16, wherein the body element has a v-shaped contact face for coupling with an intermediate contact member of the first coupling portion.

* * * * *